US008441205B2

(12) United States Patent
Hsieh et al.

(10) Patent No.: US 8,441,205 B2
(45) Date of Patent: May 14, 2013

(54) DIMMING APPARATUS TRANSMITTING CONTROL SIGNALS WITH AC POWER LINE

(75) Inventors: Min-Che Hsieh, Taipei (TW); Yi-Ching Lee, Taipei (TW); Chi-Shun Liao, Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 270 days.

(21) Appl. No.: 13/101,269

(22) Filed: May 5, 2011

(65) Prior Publication Data

US 2012/0280623 A1 Nov. 8, 2012

(51) Int. Cl.
*H05B 37/02* (2006.01)

(52) U.S. Cl.
USPC ..... 315/291; 315/297; 315/307

(58) Field of Classification Search ..... 315/291, 315/294, 297, 307
See application file for complete search history.

(56) References Cited

U.S. PATENT DOCUMENTS

| | | | | |
|---|---|---|---|---|
| 7,375,471 | B2 * | 5/2008 | Matsumura | 315/241 P |
| 2008/0012502 | A1 * | 1/2008 | Lys | 315/247 |
| 2012/0043912 | A1 * | 2/2012 | Huynh et al. | 315/297 |

* cited by examiner

*Primary Examiner* — Jason M Crawford
(74) *Attorney, Agent, or Firm* — Chun-Ming Shih; HDLS IPR Services

(57) ABSTRACT

A dimming apparatus transmitting control signals with AC power line (10) is applied to an alternating current power source (20), a light emitting diode driving power unit (40), and a light emitting diode unit (30). The dimming apparatus transmitting control signals with AC power line (10) includes an input voltage detection unit (102), a one-shot signal unit (104), an AND gate unit (106), a pulse width modulation dimming signal unit (108), an inductor unit (110), a first switch unit (114), a dimming signal recovery unit (124), and a second switch unit (122). The input voltage detection unit (102) is electrically connected to the alternating current power source (20), the inductor unit (110), and the one-shot signal unit (104). The AND gate unit (106) is electrically connected to the one-shot signal unit (104), the pulse width modulation dimming signal unit (108), and the first switch unit (114). The dimming signal recovery unit (124) is electrically connected to the light emitting diode driving power unit (40), the inductor unit (110), the first switch unit (114), and the second switch unit (122). The second switch unit (122) is electrically connected to the light emitting diode unit (30).

9 Claims, 3 Drawing Sheets

DIMMING APPARATUS TRANSMITTING CONTROL SIGNALS WITH AC POWER LINE

BACKGROUND OF THE INVENTION

1. Field of the Invention

The present invention relates to a dimming apparatus, and in particular to a dimming apparatus transmitting control signals with AC power line.

2. Description of Prior Art

Dimming is a very common technology. Alternating current power sources and dimming signals can't be transmitted in the same time with an AC power line in most of the dimming technologies. Extra signal lines will be needed for transmitting dimming signals. This will cause wastage of line layout and will increase cost.

SUMMARY OF THE INVENTION

In order to solve the above-mentioned problems, an object of the present invention is to provide a dimming apparatus transmitting control signals with AC power line.

In order to achieve the object of the present invention mentioned above, a dimming apparatus transmitting control signals with AC power line of the present invention is applied to an alternating current power source, a light emitting diode driving power unit, and a light emitting diode unit. The light emitting diode unit is electrically connected to the light emitting diode driving power unit.

The dimming apparatus transmitting control signals with AC power line includes an input voltage detection unit, a one-shot signal unit, an AND gate unit, a pulse width modulation dimming signal unit, an inductor unit, a first switch unit, a dimming signal recovery unit, and a second switch unit.

The input voltage detection unit is electrically connected to the alternating current power source. The one-shot signal unit is electrically connected to the input voltage detection unit. The AND gate unit is electrically connected to the one-shot signal unit. The pulse width modulation dimming signal unit is electrically connected to the AND gate unit. The inductor unit is electrically connected to the alternating current power source and the input voltage detection unit. The first switch unit is electrically connected to the inductor unit and the AND gate unit. The dimming signal recovery unit is electrically connected to the light emitting diode driving power unit, the inductor unit, and the first switch unit. The second switch unit is electrically connected to the dimming signal recovery unit and the light emitting diode unit.

A low voltage signal is sent from the input voltage detection unit to the one-shot signal unit when the alternating current power source is at a low voltage detected by the input voltage detection unit. A one-shot signal is sent from the one-shot signal unit to the AND gate unit when the low voltage signal is received by the one-shot signal unit. A pulse width modulation dimming signal is sent from the pulse width modulation dimming signal unit to the AND gate unit.

The first switch unit is controlled by the AND gate unit after the one-shot signal and the pulse width modulation dimming signal are operated by the AND gate unit with AND gate logic operation. The inductor unit is charged by the alternating current power source when the first switch unit is conducted. The alternating current power source is discharged by the inductor unit when the first switch unit is not conducted. An alternating current dimming signal is generated from the combination of the charge-discharge of the inductor unit and the alternating current power source. The second switch unit is controlled by the dimming signal recovery unit with the pulse width modulation dimming signal recovered by the dimming signal recovery unit to dim the light emitting diode unit after the alternating current dimming signal is received by the dimming signal recovery unit.

The efficiency of the present invention is to transmit dimming signals with an AC power line.

DETAILED DESCRIPTION OF THE INVENTION

Figure 1:
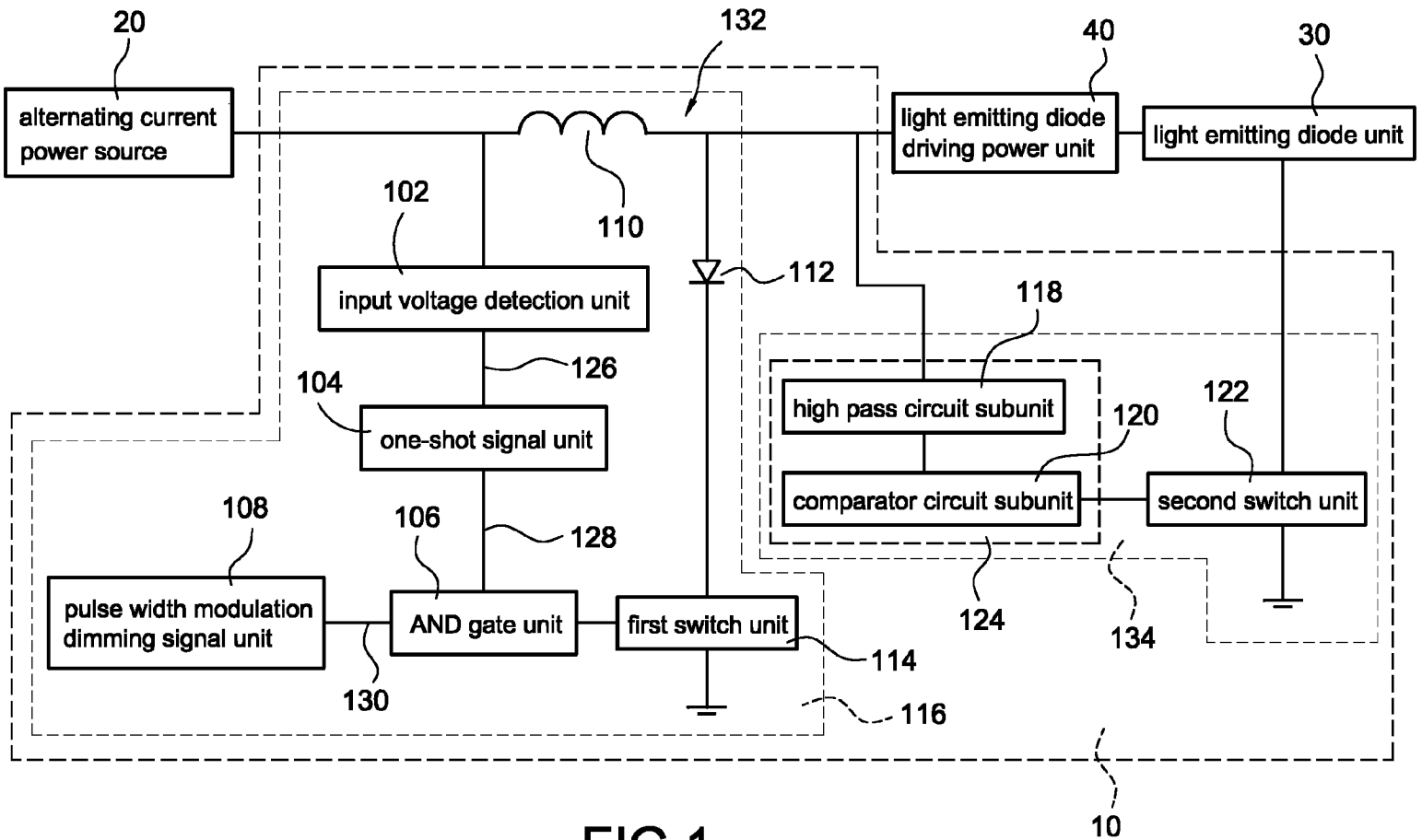
FIG. 1 shows a block diagram of the dimming apparatus transmitting control signals with AC power line of the present invention.

FIG. 1 shows a block diagram of the dimming apparatus transmitting control signals with AC power line of the present invention. The dimming apparatus transmitting control signals with AC power line 10 of the present invention is applied to an alternating current power source 20, a light emitting diode driving power unit 40, and a light emitting diode unit 30. The light emitting diode unit 30 is electrically connected to the light emitting diode driving power unit 40.

The dimming apparatus transmitting control signals with AC power line 10 includes a transmission unit 116 and a reception driving unit 134. The transmission unit 116 includes an input voltage detection unit 102, a one-shot signal unit 104, an AND gate unit 106, a pulse width modulation dimming signal unit 108, an inductor unit 110, a diode unit 112, and a first switch unit 114. The reception driving unit 134 includes a second switch unit 122 and a dimming signal recovery unit 124. The dimming signal recovery unit 124 includes a high pass circuit subunit 118 and a comparator circuit subunit 120.

The input voltage detection unit 102 is electrically connected to the alternating current power source 20. The one-shot signal unit 104 is electrically connected to the input voltage detection unit 102. The AND gate unit 106 is electrically connected to the one-shot signal unit 104. The pulse width modulation dimming signal unit 108 is electrically connected to the AND gate unit 106. The inductor unit 110 is electrically connected to the alternating current power source 20 and the input voltage detection unit 102. The first switch unit 114 is electrically connected to the inductor unit 110 and the AND gate unit 106. The dimming signal recovery unit 124 is electrically connected to the light emitting diode driving power unit 40, the inductor unit 110, and the first switch unit 114.

The second switch unit 122 is electrically connected to the dimming signal recovery unit 124 and the light emitting diode unit 30. The diode unit 112 is electrically connected to the inductor unit 110 and the first switch unit 114. The high pass circuit subunit 118 is electrically connected to the light emitting diode driving power unit 40, the diode unit 112, and the inductor unit 110. The comparator circuit subunit 120 is electrically connected to the high pass circuit subunit 118 and the second switch unit 122.

The AND gate unit 106 could be an AND gate. The inductor unit 110 could be an inductor. The diode unit 112 could be a diode. The first switch unit 114 could be a transistor switch. The second switch unit 122 could be a transistor switch.

A low voltage signal 126 is sent from the input voltage detection unit 102 to the one-shot signal unit 104 when the alternating current power source 20 is at a low voltage (for example 20 voltages), which is detected by the input voltage detection unit 102. A one-shot signal 128 (for example 30 microseconds) is sent from the one-shot signal unit 104 to the AND gate unit 106 when the low voltage signal 126 is received by the one-shot signal unit 104.

A pulse width modulation dimming signal 130 is sent from the pulse width modulation dimming signal unit 108 to the AND gate unit 106. The first switch unit 114 is controlled by the AND gate unit 106 after the one-shot signal 128 and the pulse width modulation dimming signal 130 are operated by the AND gate unit 106 with AND gate logic operation. From the truth table of view, the first switch unit 114 is controlled to conduct by the AND gate unit 106 when both the one-shot signal 128 and the pulse width modulation dimming signal 130 are logic-one (or T, i.e. both are not logic-zero). Or the first switch unit 114 is not conducted.

Figure 2:
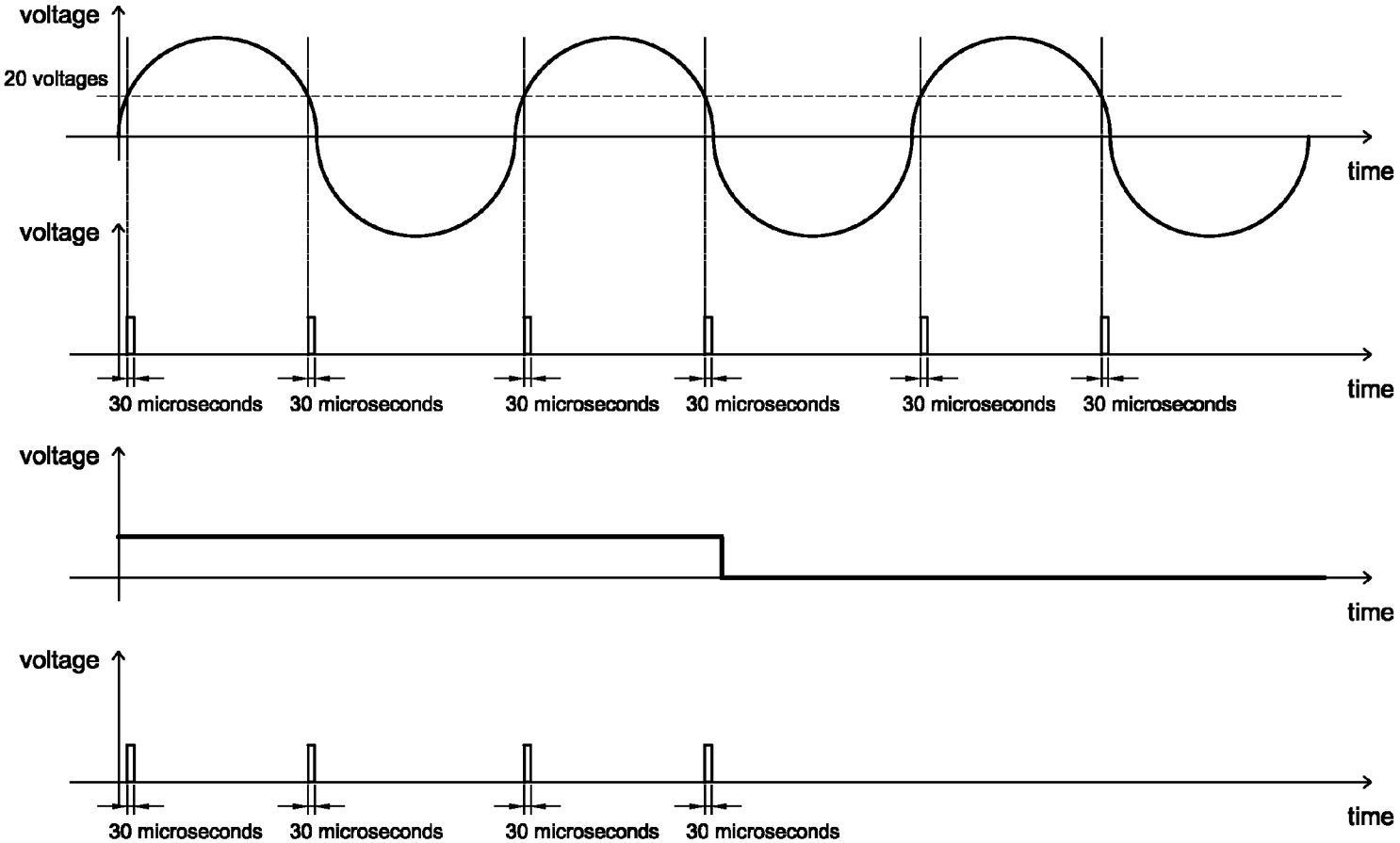
FIG. 2 shows a waveform diagram of the dimming apparatus transmitting control signals with AC power line of the present invention.

FIG. 2 shows a waveform diagram of the dimming apparatus transmitting control signals with AC power line of the present invention. From top to bottom, the first waveform diagram shows the alternating current power source 20. The second waveform diagram shows the one-shot signal 128. The third waveform diagram shows the pulse width modulation dimming signal 130. The fourth waveform diagram shows the signals of the first switch unit 114 being controlled by the AND gate unit 106.

Figure 3:
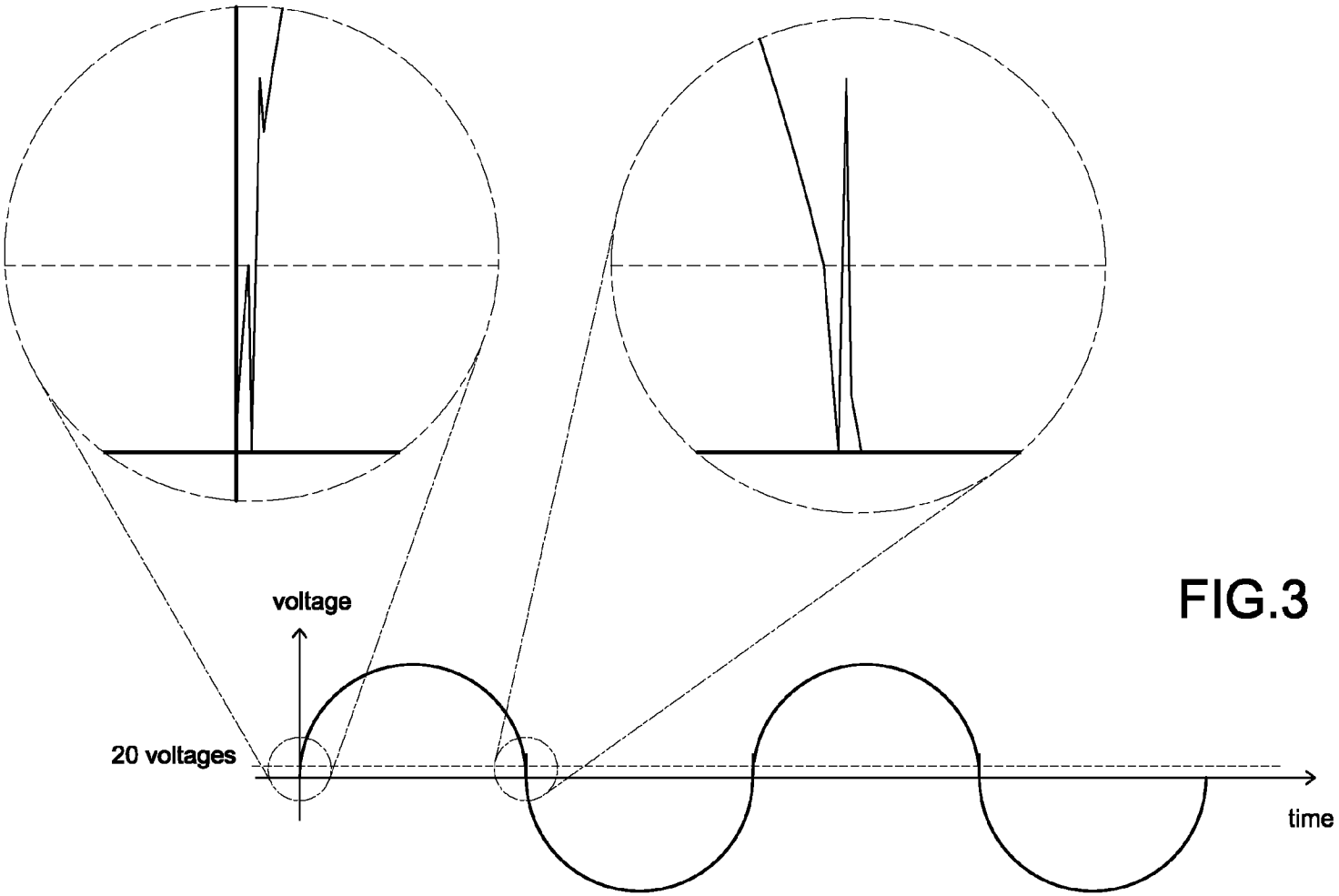
FIG. 3 shows a waveform diagram of the dimming apparatus transmitting control signals with AC power line of the present invention.

The electric potential of the alternating current power source 20 is pulled down, and the inductor unit 110 is charged by the alternating current power source 20, when the first switch unit 114 is conducted (the conduction time is for example only 30 microseconds as shown above). Then, the alternating current power source 20 is discharged by the inductor unit 110 when the first switch unit 114 is not conducted. An alternating current dimming signal 132 is generated from the combination of the charge-discharge of the inductor unit 110 and the alternating current power source 20. FIG. 3 shows the waveform diagram of the alternating current dimming signal 132.

The alternating current dimming signal 132 is transmitted to the light emitting diode driving power unit 40 and the dimming signal recovery unit 124. The light emitting diode unit 30 is provided the driving power by the light emitting diode driving power unit 40 after the alternating current dimming signal 132 is received by the light emitting diode driving power unit 40.

The second switch unit 122 is controlled by the dimming signal recovery unit 124 with the pulse width modulation dimming signal 130 recovered by the dimming signal recovery unit 124 to dim the light emitting diode unit 30 after the alternating current dimming signal 132 is received by the dimming signal recovery unit 124. The detail thereof is as following:

The alternating current dimming signal 132 is proceeded with high pass filtering by the high pass circuit subunit 118 to filter out the alternating current power source 20 and to remain the charge-discharge of the inductor unit 110 after the alternating current dimming signal 132 is received by the high pass circuit subunit 118. Then the second switch unit 122 is controlled by the pulse width modulation dimming signal 130 recovered from the comparison between a triangular wave and the charge-discharge of the inductor unit 110 to dim the light emitting diode unit 30.

The present invention can transfer the pulse width modulation dimming signals to attach in the alternating current power source, and transmit to the light emitting diode side with an AC power line. The light emitting diodes are dimmed by the pulse width modulation dimming signals recovered with high pass filtering by the light emitting diode side.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A dimming apparatus transmitting control signals with AC power line (10) applied to an alternating current power source (20), a light emitting diode driving power unit (40), and a light emitting diode unit (30), the light emitting diode unit (30) being electrically connected to the light emitting diode driving power unit (40), the dimming apparatus transmitting control signals with AC power line (10) including:

an input voltage detection unit (102) electrically connected to the alternating current power source (20);

a one-shot signal unit (104) electrically connected to the input voltage detection unit (102), a low voltage signal (126) being sent from the input voltage detection unit (102) to the one-shot signal unit (104) when the alternating current power source (20) is detected by the input voltage detection unit (102) to be at a low voltage;

an AND gate unit (106) electrically connected to the one-shot signal unit (104), a one-shot signal (128) being sent from the one-shot signal unit (104) to the AND gate unit (106) when the low voltage signal (126) is received by the one-shot signal unit (104);

a pulse width modulation dimming signal unit (108) electrically connected to the AND gate unit (106), a pulse width modulation dimming signal (130) being sent from the pulse width modulation dimming signal unit (108) to the AND gate unit (106);

an inductor unit (110) electrically connected to the alternating current power source (20) and the input voltage detection unit (102);

a first switch unit (114) electrically connected to the inductor unit (110) and the AND gate unit (106), the first switch unit (114) being controlled by the AND gate unit (106) after the one-shot signal (128) and the pulse width modulation dimming signal (130) are operated by the AND gate unit (106) with AND gate logic operation, the inductor unit (110) being charged by the alternating current power source (20) when the first switch unit (114) is conducted, the alternating current power source (20) being discharged by the inductor unit (110) when the first switch unit (114) is not conducted, an alternating current dimming signal (132) being generated from the combination of the charge-discharge of the inductor unit (110) and the alternating current power source (20);

a dimming signal recovery unit (124) electrically connected to the light emitting diode driving power unit (40), the inductor unit (110), and the first switch unit (114); and a second switch unit (122) electrically connected to the dimming signal recovery unit (124) and the light emitting diode unit (30), wherein the second switch unit (122) is controlled by the dimming signal recovery unit (124) with the pulse width modulation dimming signal (130) recovered by the dimming signal recovery unit (124) to dim the light emitting diode unit (30) after the alternating current dimming signal (132) is received by the dimming signal recovery unit (124).

2. The dimming apparatus transmitting control signals with AC power line (10) in claim 1, further including a diode unit (112) electrically connected to the inductor unit (110) and the first switch unit (114).

3. The dimming apparatus transmitting control signals with AC power line (10) in claim 2, wherein the dimming signal recovery unit (124) includes a high pass circuit subunit (118) electrically connected to the light emitting diode driving power unit (40), the diode unit (112), and the inductor unit (110).

4. The dimming apparatus transmitting control signals with AC power line (10) in claim 3, wherein the dimming signal recovery unit (124) further includes a comparator circuit subunit 120 electrically connected to the high pass circuit subunit (118) and the second switch unit (122).

5. The dimming apparatus transmitting control signals with AC power line (10) in claim 4, wherein the AND gate unit (106) is an AND gate.

6. The dimming apparatus transmitting control signals with AC power line (10) in claim 5, wherein the inductor unit (110) is an inductor.

7. The dimming apparatus transmitting control signals with AC power line (10) in claim 6, wherein the diode unit 112 is a diode.

8. The dimming apparatus transmitting control signals with AC power line (10) in claim 7, wherein the first switch unit (114) is a transistor switch.

9. The dimming apparatus transmitting control signals with AC power line (10) in claim 8, wherein the second switch unit (122) is a transistor switch.

* * * * *